United States Patent [19]

Yan

[11] 4,376,098

[45] Mar. 8, 1983

[54] TWO-STAGE URANIUM IN SITU LEACHING PROCESS

[75] Inventor: Tsoung-Yuan Yan, Philadelphia, Pa.

[73] Assignee: Mobil Oil Corporation, New York, N.Y.

[21] Appl. No.: 181,047

[22] Filed: Aug. 25, 1980

[51] Int. Cl.[3] ..... C22B 60/02; C01G 43/00; E21B 43/28

[52] U.S. Cl. ..... 423/20; 299/4

[58] Field of Search ..... 423/17, 18, 20; 299/4.5

[56] References Cited

U.S. PATENT DOCUMENTS

| | | | |
|---|---|---|---|
| 3,025,131 | 3/1962 | Lerner | 423/20 |
| 3,915,499 | 9/1975 | Mallon et al. | 299/4 |
| 4,043,599 | 8/1977 | Lingane et al. | 299/4 |
| 4,105,253 | 8/1978 | Showalter | 423/18 |
| 4,214,791 | 7/1980 | Moore | 299/4 |

FOREIGN PATENT DOCUMENTS

| | | | |
|---|---|---|---|
| 846360 | 8/1960 | United Kingdom | 423/18 |

OTHER PUBLICATIONS

Merritt, Robert C., "The Extractive Metallurgy of Uranium", 1971, pp. 63, 111, 117 and 118.

*Primary Examiner*—Edward A. Miller
*Assistant Examiner*—Matthew A. Thexton
*Attorney, Agent, or Firm*—C. A. Huggett; M. G. Gilman; J. K. AboKhair

[57] ABSTRACT

A two-stage in situ uranium leaching process is described wherein $H_2SO_4$/oxidant is used as the principal leaching solution. Prior to leaching, the formation is treated with a dilute solution of hydrochloric acid, carbonic acid, or other acid (without oxidant) capable of removing the most accessible portions of $CaCO_3$. The pretreatment improves the permeability of the formation and precludes plugging with $CaSO_4$. The invention is particularly advantageous when applied to ores which cannot readily be leached with alkaline solutions.

7 Claims, No Drawings

TWO-STAGE URANIUM IN SITU LEACHING PROCESS

FIELD OF THE INVENTION

This invention relates generally to the field of in situ leaching of uranium, in particular to the leaching of uranium values from ores which are not amenable to alkaline or neutral carbonate leaching processes.

BACKGROUND OF THE INVENTION

It has been found that some uranium ores are not amenable to alkaline or neutral carbonate leaching. These refractory ores are readily leached using dilute sulfuric acid (about 0.1–1% by weight) and oxygen under pressure. From the standpoint of cost-effectiveness, sulfuric acid is the most desirable leaching chemical for use in the in situ leaching of uranium ores. HCl is more costly and interferes with the subsequent ion exchange processes used for the recovery of uranium values from the leachate solution that is produced from the formation. $HNO_3$ is very expensive, and its potential for water pollution makes it unsuitable as a leaching chemical. Other acids such as acetic acid are much more expensive than sulfuric acid and interfere with the recovery of uranium values by ion exchange.

Unfortunately, sulfuric acid has a long recognized disadvantage as a leaching chemical for ores which contain calcite (or $CaCO_3$), namely, the potential plugging of the formation by the precipitation of $CaSO_4$. Various methods have been devised in the past to circumvent this problem of $CaSO_4$ plugging and the resulting loss in the formation permeability, but they have not been particularly successful. The importance of this problem is underscored by the fact that uranium-bearing ores are most often found in sandstone formations. There is always some calcium carbonate present in sandstone. For example, the $CaCO_3$ content of uranium ores at Crownpoint, New Mexico, which are refractory to alkaline and neutral carbonate leaching, is in the range of from 0.6% to 6.20%.

The problem of calcite control in an in situ leaching operation is addressed in U.S. Pat. No. 4,103,963, which describes an in situ leaching operation which is representative of the prior art to this invention. The mechanics of the invention may generally follow the disclosure of that patent. Thus, it is believed to be readily apparent to persons skilled in this art upon reading the disclosure of U.S. Pat. No. 4,103,963 in conjunction with the disclosure herein how to practice the present invention.

SUMMARY AND DETAILED DESCRIPTION OF THE INVENTION

In view of the large amount of uranium ore in the United States which is not amenable to in situ carbonate leaching processes, it has long been a goal of the industry to develop a process using $H_2SO_4/O_2$ for leaching uranium out of $CaCO_3$ containing refractory ores which is economical and which overcomes the loss of formation permeability heretofore observed. This goal is satisfied in accordance with this invention by conducting, in combination, a two-stage in situ leaching process. The first stage involves the removal of "labile" $CaCO_3$ and the second stage involves conventional sulfuric acid leaching of the treated formation.

In the first step of the process in accordance with this invention, labile calcium carbonate is removed by pumping the necessary amount of carbonic acid (formed by the introduction of high pressure $CO_2$ into water at the bottom of the well bore) or hydrochloric acid through the formation. By the term "labile" as used in this application, it is meant that calcite in the formation that can readily react with the dilute $H_2SO_4$ used in the leaching step. Not all of the calcite in the formation can be attacked by the dilute sulfuric acid leaching solution due to the physical configuration and accessibility of the calcite in the formation. It is estimated that the labile $CaCO_3$ content of the formation is about one-half that of the total $CaCO_3$ content of a typical formation. The first step removes the labile calcite so that it does not form insoluble $CaSO_4$ in the formation as a result of reaction with dilute $H_2SO_4$ in the second, acid leaching step of the process.

The preferred acid for use in the first step is carbonic acid, formed, as indicated above, by the introduction of high pressure $CO_2$ into the water that is pumped through the formation. The effluent solution from the first step is stripped of $CO_2$ in an apparatus such as a Spiractor to recover the $CaCO_3$ in solution as calcite. The $CO_2$ gas evolved is recovered for recycling. If hydrochloric acid is used, the effluent is ordinarily disposed of, unless calcium chloride in solution can economically be recovered as a by-product. The necessary duration of the first stage operation in accordance with this invention is signaled by the achievement of a predetermined pH of the effluent solution, about 4 if carbonic acid is used, and about 3 if HCl is used. In addition to the removal of labile calcite, this first-stage treatment of the formation with carbonic acid or hydrochloric acid greatly improves the permeability of the formation.

Upon the reaching of the predetermined pH of the effluent water produced from the formation during the first stage of the process, a few (about 3) pore volumes of water are flushed through the formation in preparation for the leaching step. A leaching solution consisting of about 0.1–1% by weight of $H_2SO_4$, and which is treated with gaseous $O_2$ at the bottom hole pressure, is pumped through the formation to leach uranium mineral values therefrom. The uranium value is recovered from the leachate using conventional techniques, such as ion exchange or solvent extraction and precipitation to obtain uranium as yellow cake.

In the second, leaching stage, the sulfate ion concentration in the leached solution should be adjusted by varying the amount of $H_2SO_4$ dissolved therein depending on the content of calcium ions so as not to exceed greatly the solubility product of $CaSO_4$. Generally speaking, the working range of $H_2SO_4$ concentration in the leaching solution is between 0.1 and 1% by weight, as the acid concentration is dictated by the potential loss in formation permeability due to plugging of the formation by $CaSO_4$ by-product. It is also within the scope of this invention to use additives such as aluminum ions, or polyelectrolytes and other flocculants, in the leaching solution in order to improve formation permeability. The use of these additives may also make it possible to use leaching solutions of higher $H_2SO_4$ concentration than 1% by weight. The use of leaching solutions of higher $H_2SO_4$ concentration will speed up the leaching process and thus improve the cost-effectiveness of the method.

For reasons which are not entirely understood, it is necessary to use sulfuric acid as the acid leaching component in the second stage in order to produce uranium values effectively from the formation. The use of carbonic acid or a $CO_2/O_2$ mixture as the leaching solution was found to be ineffective.

The foregoing description of this invention has been directed to particular details in accordance with the requirements of the Patent Act and for purposes of explanation and illustration. It will be apparent, however, to those skilled in this art that many modifications and changes may be made without departing from the scope and spirit of the invention. It is further apparent that persons of ordinary skill in this art will, on the basis of this disclosure, be able to practice the invention within a broad range of process conditions. It is my intention in the following claims to cover all such equivalent modifications and variations as fall within the true scope and spirit of my invention.

What is claimed is:

1. A process for the in situ leaching of uranium values from calcite-containing formations wherein the formation is penetrated by at least one injection well and at least one production well in communication with the injection well, which comprises;

(a) a first step wherein labile calcite in the formation is removed by pumping through, and removing from, the formation a carbonic acid solution that attacks and dissolves a substantial portion of said labile calcite, wherein the carbonic acid solution has a pH not less than 3; and (b) a second subsequent step wherein the uranium values are leached from the formation by pumping through, and removing from, said formation an aqueous leaching solution containing about 0.1 to 1% by weight sulfuric acid and an oxidant.

2. The process of claim 1 wherein the oxidant in step (b) is obtained by introducing gaseous oxygen into the leaching solution.

3. The process of claim 1 wherein the carbonic acid solution is obtained by introducing high pressure carbon dioxide into water.

4. The process of claim 1, 2, or 3 wherein the first step is terminated when the pH of the carbonic acid solution removed from the formation reaches a predetermined value.

5. The process of claim 4 wherein the predetermined pH value is about 4.

6. The process of claim 1, further including a step between steps (a) and (b) wherein the formation is flushed with about 3 pore volumes of water.

7. The process of claim 1 wherein the sulfuric acid concentration is kept sufficiently low as to prevent calcium sulfate precipitation.

* * * * *